US010575567B1

(12) United States Patent
Krechmaras

(10) Patent No.: US 10,575,567 B1
(45) Date of Patent: Mar. 3, 2020

(54) BRASSIERE HAVING SCOOPED BACK BAND

(71) Applicant: Ellana M. Krechmaras, Reston, VA (US)

(72) Inventor: Ellana M. Krechmaras, Reston, VA (US)

( * ) Notice: Subject to any disclaimer, the term of this patent is extended or adjusted under 35 U.S.C. 154(b) by 107 days.

(21) Appl. No.: 15/912,608

(22) Filed: Mar. 6, 2018

Related U.S. Application Data

(60) Provisional application No. 62/601,113, filed on Mar. 10, 2017.

(51) Int. Cl.

| | |
|---|---|
| ***A41C 1/14*** | (2006.01) |
| ***A41C 3/00*** | (2006.01) |
| ***A41F 15/00*** | (2006.01) |
| ***A41C 3/12*** | (2006.01) |

(52) U.S. Cl.
CPC ..... *A41C 3/0021* (2013.01); *A41C 3/12* (2013.01); *A41F 15/00* (2013.01); *A41D 2300/326* (2013.01)

(58) Field of Classification Search
CPC ..... A41C 3/12; A41C 1/06
USPC ..... 450/41
See application file for complete search history.

(56) References Cited

U.S. PATENT DOCUMENTS 2,281,363 A * 4/1942 Lyford ..... A41F 15/00 2/323
2,392,724 A * 1/1946 Cohen ..... A41C 1/06 450/8
2,657,392 A * 11/1953 Jackson ..... A41F 15/00 2/323
2,733,445 A * 2/1956 Rotelli ..... A41C 3/0021 450/68

* cited by examiner

*Primary Examiner* — Timothy K Trieu
(74) *Attorney, Agent, or Firm* — W&C IP

(57) ABSTRACT

A brassiere is provided to address the lack of bust support provided by traditional brassieres. The brassiere incorporates a scooped back band having constructed and seamed wings and asymmetric rings at the back strap joint.

10 Claims, 9 Drawing Sheets

BRASSIERE HAVING SCOOPED BACK BAND

CROSS REFERENCE TO RELATED APPLICATIONS

This application claims the benefit of U.S. application 62/601,113, filed Mar. 10, 2017. This application is incorporated herein by reference in its entirety.

FIELD OF THE INVENTION

Embodiments of the invention provide a brassiere for improved bust support having a scooped back band and asymmetric rings at the back strap joint.

BACKGROUND OF THE INVENTION

To address the functionality of the brassiere, improvements have previously only been made to the cups in order to help mold, lift, and shape the breast. However, such modifications do not give functional and lasting support for the bust. The weight of the breast will eventually pull the cups down and add tension to the straps and the shoulders of the wearer. The back wings of previous brassiere designs is made of one fabric piece, typically mesh or another elastic fabric, and thus does not have any structure or stability. Indeed, the elastic fabric will give in at the point of least resistance. This instability causes the back band of the brassiere to "ride-up" the wearer's back, due to the weight of the breasts, leading to discomfort and poor bust support.

SUMMARY OF THE INVENTION

Embodiments of the invention provide a brassiere having constructed and seamed back wings that address the lack of bust support provided by traditional bras. In addition to the scooped back band, asymmetric rings at the back strap joint help counteract the weight of the bust by reducing tension in the straps and preventing the band from riding up the back of the wearer. Anchoring the back band lower on the back of the wearer creates the necessary balance to the weight of the bust which results in consistent support and comfort while alleviating stress and weight at the shoulders.

One aspect of the invention provides a brassiere comprising a pair of interconnected fabric breast cups and a pair of back wings, wherein each back wing is attached to a breast cup at a first end and configured to be releasably attached to the other back wing at a second end and wherein each back wing comprises at least two fabric panels attached end to end, wherein a portion of the panels overlap at each attachment of two panels and wherein the panels are constructed such that a top surface of each panel slopes in a substantially downward direction starting from the end closest to the breast cup.

In some embodiments, each fabric panel of the back wing is constructed of a non-stretch fabric or a low-stretch fabric. In some embodiments, each back wing comprises four fabric panels. In some embodiments, the two panels closest to the fabric breast cup are constructed of a non-stretch material and the two remaining panels are constructed of a low-stretch fabric. In some embodiments, boning is contained within a pocket created by overlapping material at each attachment of two panels.

In further embodiments, the brassiere further comprises a strap connecting each fabric breast cup to a section of the top surface of the panel located furthest from the fabric breast cup. In some embodiments, the brassiere further comprises an asymmetric ring connecting each strap to each back wing. The asymmetric ring may be heart-shaped. The wider section of each asymmetric ring is oriented in a direction toward the second end of the back wing. In some embodiments, each back wing is configured to be releasably attached to the other back wing by a hook and eye closure. In some embodiments, each fabric breast cup comprises at least two fabric panels, each panel being constructed of a non-stretch fabric.

Additional features and advantages of the invention will be set forth in the description below, and in part will be apparent from the description, or may be learned by practice of the invention. The advantages of the invention can be realized and attained by the exemplary structure particularly pointed out in the written description and claims hereof as well as the appended drawings.

DETAILED DESCRIPTION

Figure 1A:
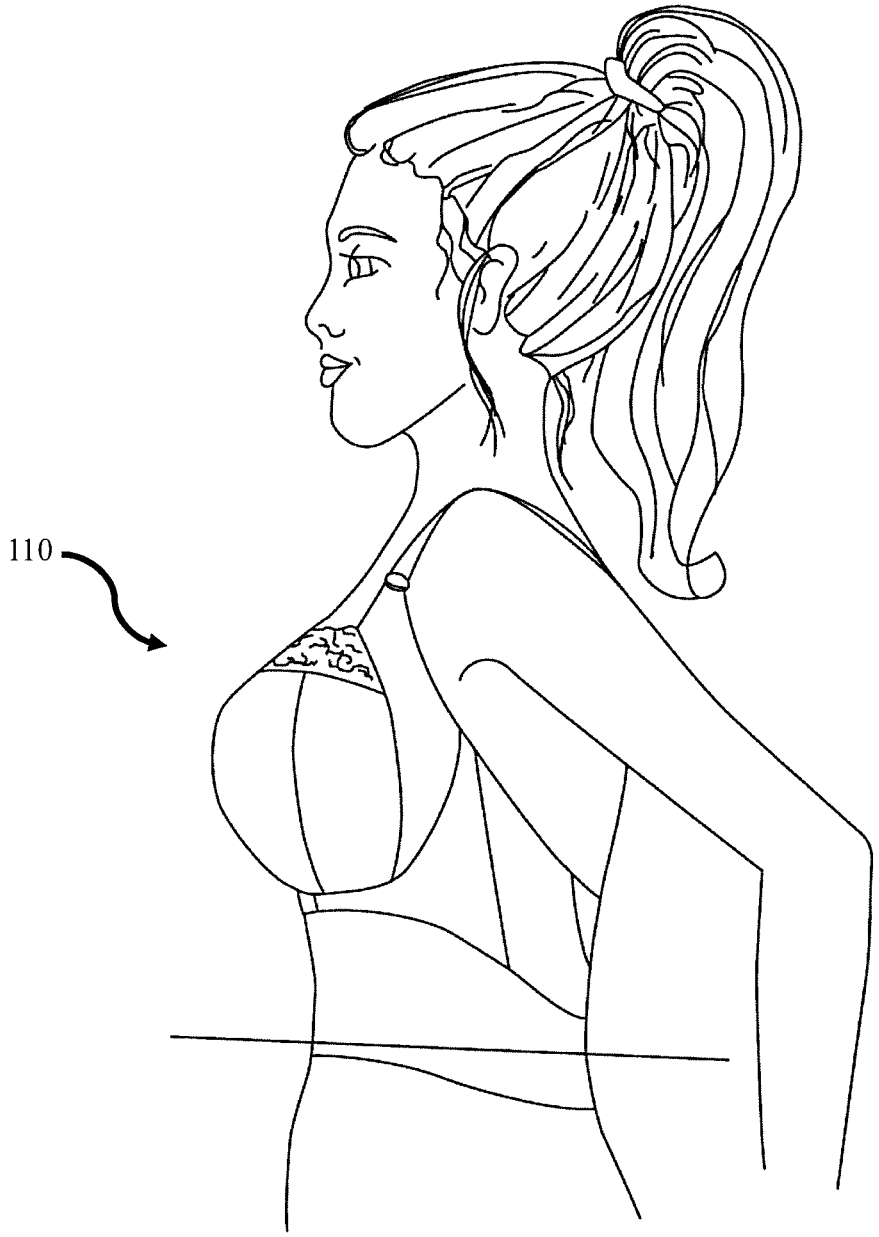
FIG. 1A is a side view of an exemplary scooped back brassiere on the body of a wearer.
Figure 1B:
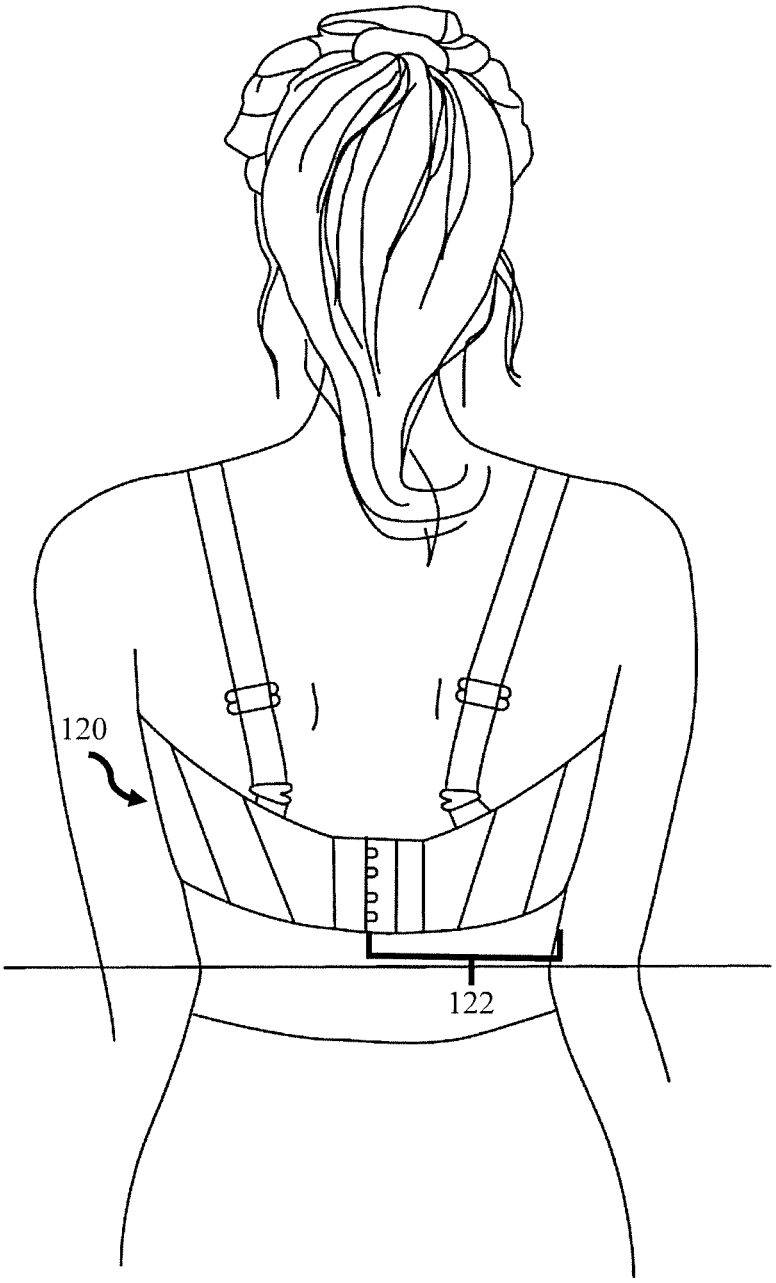
FIG. 1B is a back view of an exemplary scooped back brassiere on the body of a wearer.

The scooped back band of the brassiere described herein is engineered with built-in support to create a sturdy counterbalance to the weight of the bust. With reference to FIGS. 1A and 1B, unlike traditional brassieres, the back band 120 of the brassiere 110 sits lower on the body while the seamed and angled construction of each back wing 122 holds the scooped position of the band in place, thus allowing for 360 degree support of the bust and for further counterbalancing of the weight of the bust at the front of the brassiere. This is a significant improvement to brassieres that rely only on the breast cups and unstructured one-piece back wings for support. The construction described herein creates a better upright posture by letting support come from the band 120 and not the shoulders of the wearer.

Figure 7A:
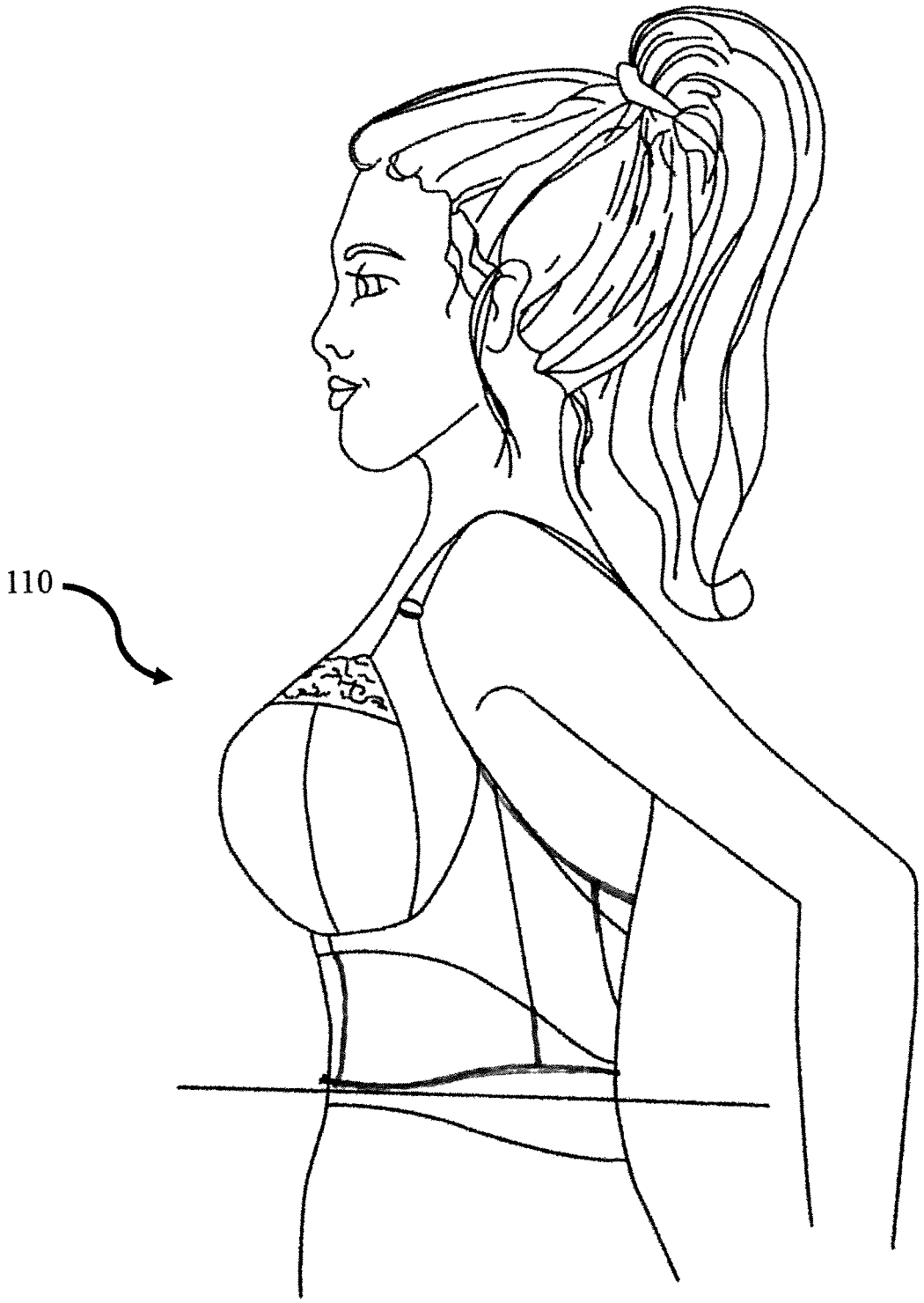
FIG. 7A is a side view of an exemplary scooped back brassiere on the body of a wearer.
Figure 7B:
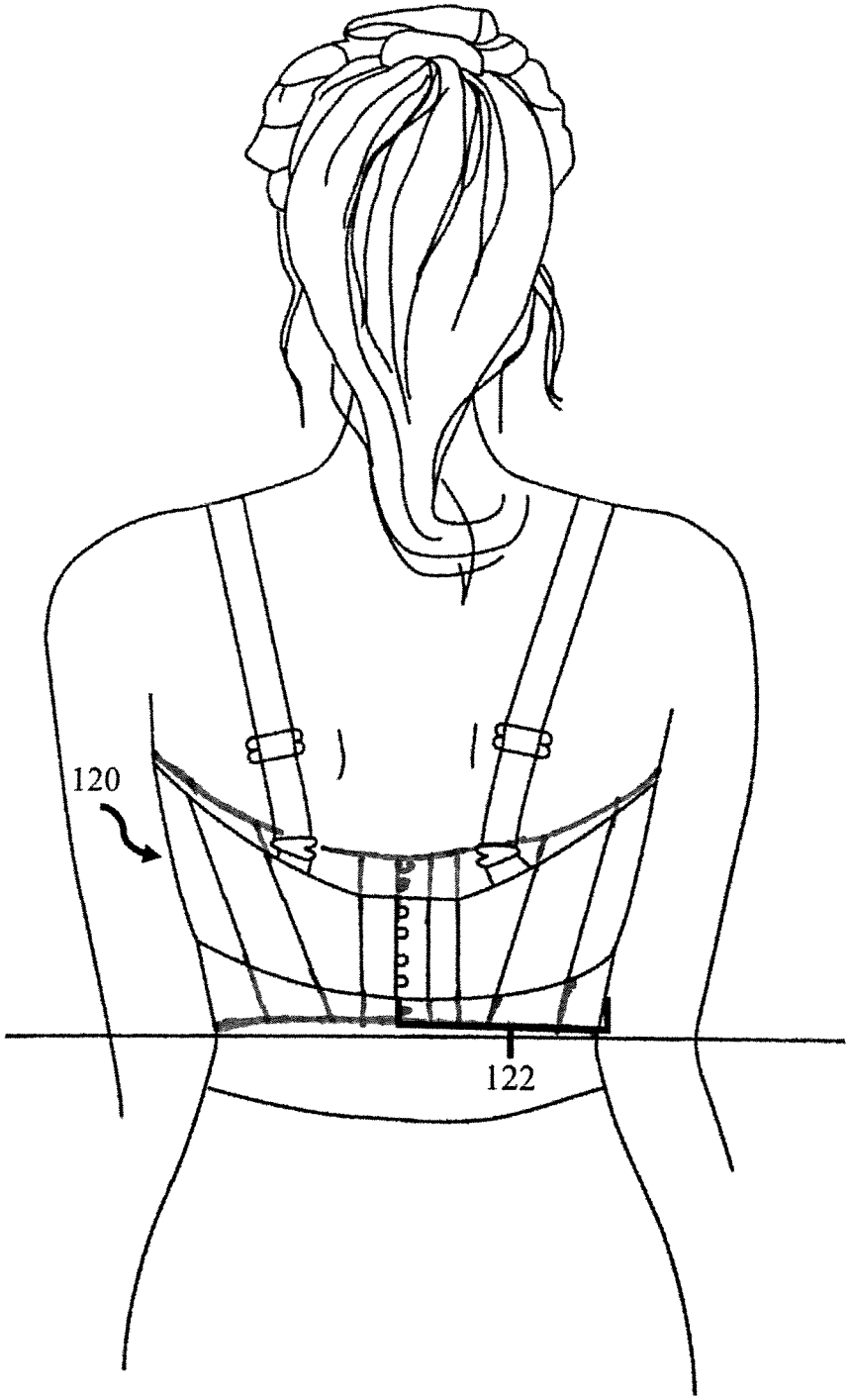
FIG. 7B is a back view of an exemplary scooped back brassiere on the body of a wearer.

The term "brassiere" encompasses any garment incorporating the features as provided herein and thus includes, for example, a corset as shown in FIGS. 7A and 7B. A "back wing" as used herein thus also refers to the back body pieces of a corset, also called the frame of a corset.

Figure 2:
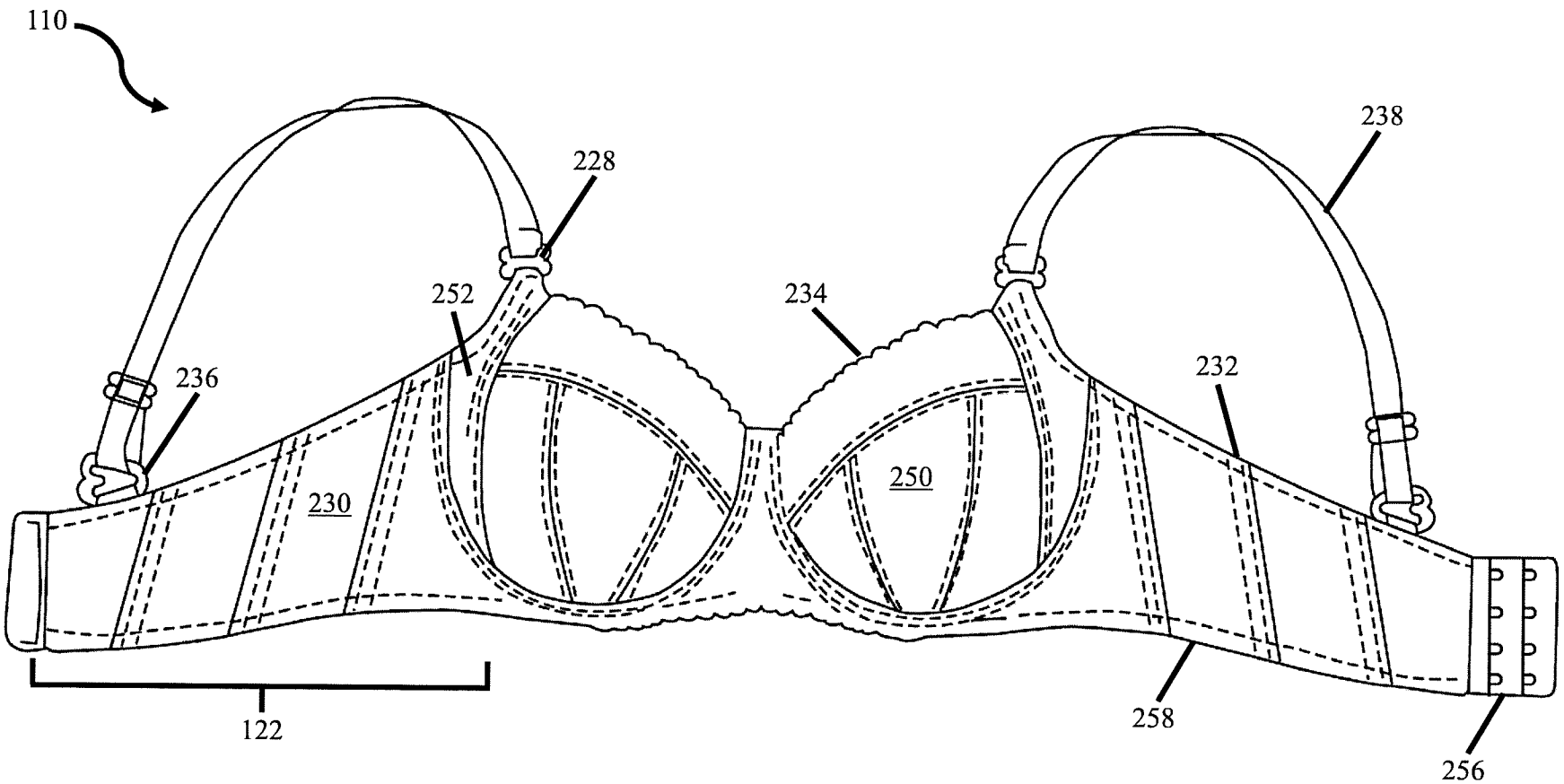
FIG. 2 is a front view of an exemplary scooped back brassiere with back wings extended.
Figure 4:
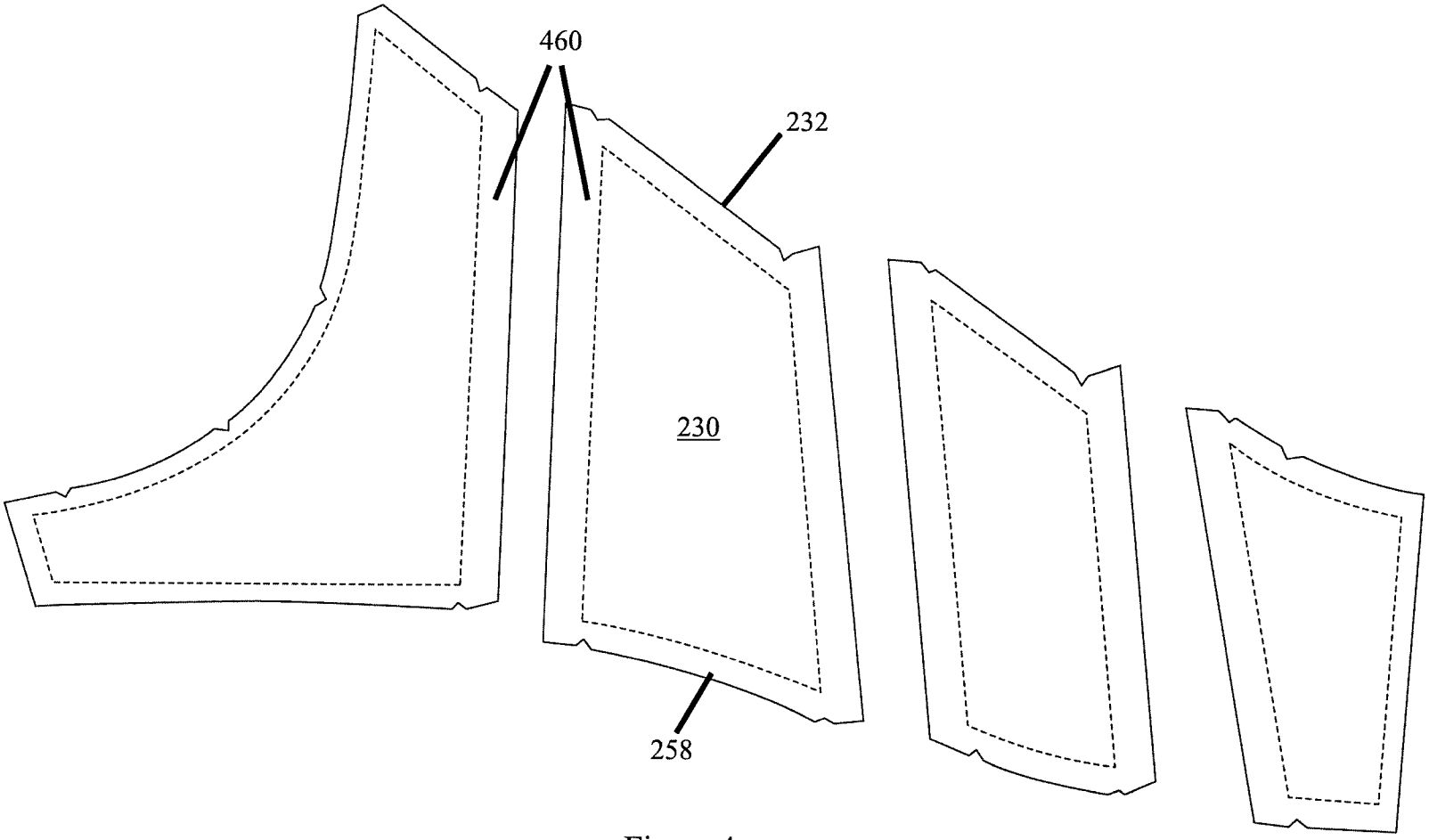
FIG. 4 show exemplary individually cut and angled panels of the back wing.

With reference to FIG. 2, each back wing 122 of the brassiere 110 comprises at least two fabric panels 230 attached end to end, e.g. 2, 3, 4, 5, 6, or more panels. In some embodiments, the back wing 122 comprises four panels 230. With reference to FIG. 4, each panel 230 is individually cut, angled, and sewn. The panels 230 are cut at an angle such that a top surface 232 of each panel 230 slopes in a substantially downward direction starting from the end closest to the breast cup 234. "Substantially downward" means that the overall top surface 232 of the panel 230 is sloped downward, i.e. the end closest to the breast cup 234 is at a higher position than the end furthest from the breast cup 234. Thus, each panel 230 has a generally trapezoidal shape. In some embodiments, the bottom surface 258 of each panel slopes in a substantially downward direction starting from the end closest to the breast cup 234. Preferably, the degree of slope of the bottom surface is less than the degree of slope of the top surface, i.e., the top surface has a steeper slope than the bottom surface. It is contemplated that some sections of the top surface 232 may be, e.g. horizontal, other than sloped in order to provide an attachment surface for the rings 236 connecting the panel 230 to the strap 238 or to facilitate the overlap of fabric at the connection of each panel 230 (FIG. 4). The scooped shape of the back band 120, as opposed to bands of traditional brassieres that lie horizontally across the back of a wearer, provides increased control, direction, and stability to the band 120.

Each panel 230 is constructed of a non-stretch fabric or a low-stretch fabric. A non-stretch fabric or material is one that is less elastic than the low-stretch fabric or material. It is to be understood that the "non-stretch" material may not be completely devoid of stretch, although in some embodiments, it includes material having no or substantially no elasticity or stretchability. The non-stretch fabric may be the same fabric used to construct the cups 234 of the brassiere 110. The low-stretch fabric may be the same or a different material as the high-stretch fabric but with a different degree of elasticity due to a higher ratio of elastomeric fibers (e.g., elastane) to non-elastomeric fibers (e.g., nylon or polyester). The elasticity or flexibility of the fabric may be indicated by the weight or thickness of the fabric, with a lower weight providing more stretch. Thus, in some embodiments, the non-stretch fabric is a higher weight than the low-stretch fabric. In some embodiments, the weight of the non-stretch fabric is about at least 100 GSM, at least 150 GSM, or at least 180 GSM or higher. Exemplary fabrics are known in the art and include, but are not limited to, simplex fabric, lace, elastane (spandex) blends, lycra blends and combinations or blends thereof, e.g. lace having different percentages of elastane may also be used. In some embodiments, the non-stretch material is lined with tricot or another stabilizing or reinforcing fabric in order to further minimize stretch. The stabilizing fabric may be at least about 10 denier, at least about 15 denier, or at least about 20 denier or higher. The low-stretch fabric or material is one that is more elastic than the non-stretch material.

The back wing 122 may have any combination and order of non-stretch and low-stretch fabric panels 230. For example, a back wing 122 having four panels 230 may have four non-stretch panels; three non-stretch panels and one low-stretch panel; two non-stretch panels and two low-stretch panels; one non-stretch panel and three low-stretch panels; or four low-stretch panels. Further, the two back wings 122 of the brassiere may have different arrangements of non-stretch and low-stretch fabric panels 230. In some embodiments, a back wing 122 as described herein includes four panels 230 with the two panels 230 closest to the fabric breast cup constructed of a non-stretch fabric and the two remaining panels 230 constructed of a low-stretch fabric.

The fabric may have 4-way stretch in which the fabric stretches in both a crosswise and lengthwise direction or the fabric may have a 2-way stretch in which the fabric stretches primarily in either a crosswise or lengthwise direction. Fabric with a vertical grain provide a crosswise stretch while fabric with a horizontal grain provide a lengthwise stretch. The back wing 122 may have any combination and order of fabric panels 230 that stretch primarily in crosswise or lengthwise direction or both. In some embodiments, to the extent that each panel has elasticity, the two panels 230 closest to the fabric breast cup have a horizontal grain (or lengthwise stretch) and the two remaining panels 230 have a vertical grain (or crosswise stretch).

In some embodiments, the cut of the fabric for each panel is angled such that when assembled the grain of the fabric is substantially perpendicular or parallel to a transverse plane of the wearer.

Figure 3:
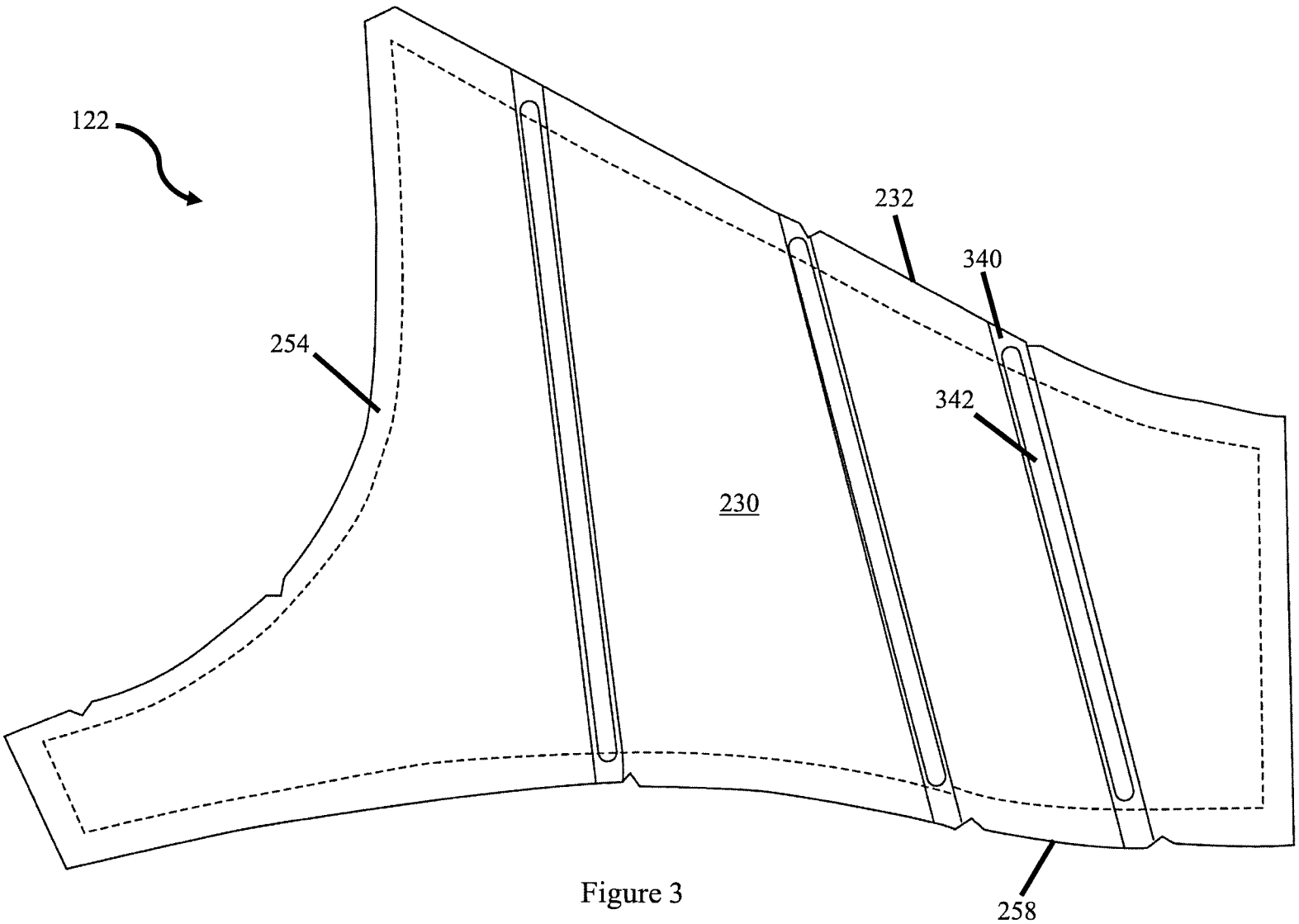
FIG. 3 shows an exemplary back wing having four angled panels and boning inserted in the pockets formed between each panel.
Figure 5A:
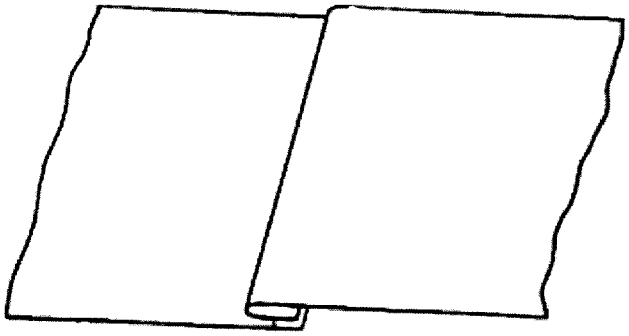
FIGS. 5A and 5B show an exemplary fold of fabric adjoining two panels to create a pocket in which boning may be inserted.
Figure 5B:
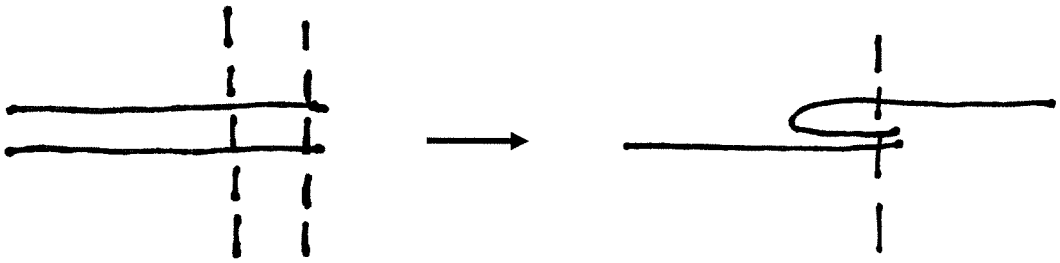

With reference to FIGS. 3 and 4, in some embodiments, each panel 230 of the band 120 is connected to the adjoining panel 230 by overlapping fabric 460 to create a stitched/seamed pocket 340. In some embodiments, the pocket is created by inverting one panel and placing it on top of the adjacent panel so that the dotted lines as shown in FIG. 4 overlap (see FIG. 5B). The panels are then stitched together (e.g., by single needle stitching or lockstitch) at the dotted line on the end of the panel containing the fabric to be overlapped 460 and at the edge of panels at the same end. After stitching, the inverted panel is folded over the stitch to assume its correct orientation along the back wing. Another stitch is then added through the three layers of fabric, created from folding the panel, thus forming the pocket. FIG. 5A is an example of two pieces of fabric that are overlayed to form a pocket as described herein. FIG. 5B is an alternate view of the fold with each of the three stitches shown with dotted lines. It is also contemplated that the pocket may be created by simply overlapping the two ends of adjoining panels.

In some embodiments, one or more of the pockets 340 include boning 342. In some embodiments, the boning 342 may be sewn into the top surface 232 of the band 120 and float at the bottom which allows for greater flexibility in movement of the body while the rest of the band 120 stays in place during use. It is contemplated that the boning may be sewn topically, however, sewing the boning into pockets provides increased support. In some embodiments, the boning 342 is telescoping boning in which at least two boning pieces are overlapped in a telescoping manner to allow the overall length of the boning to vary as the wearer moves, thus providing further stability to the garment. The bones reinforce and stabilize the angled panels and sloping position of the back band. The introduction of boning also helps create stability between panels having contrasting fabrics with different elasticities.

As shown in FIG. 2, each cup 234 of the brassiere 110 may also comprise at least two fabric panels 250, e.g. 2, 3, 4, 5, 6, or more panels, each panel 250 being constructed of non-stretch fabric or low-stretch fabric. In some embodiments, the slide sling 252 of the cup 234 sits higher at the underarm of the wearer and connects by underwire 254 to the first back wing panel 122. The extra height provided by this arrangement creates additional wireplay to allow full coverage of the side breast tissue and starts the downward angle of the band 120.

In some embodiments, the brassiere 110 described herein is a strapless brassiere. In some embodiments, the brassiere 110 includes a strap 238 connecting each fabric breast cup 234 to a section of the top surface 232 of the panel 230 located furthest from the fabric breast cup 234. As is known in the art, each strap 238 may be adjustable to different lengths to provide a better fit for the wearer. Each strap 238 may connect a breast cup 234 with its corresponding back wing 122, e.g. connecting the left cup to the left back wing, or each strap 238 may connect a breast cup 234 with the opposite back wing 122, e.g. connecting the left cup to the right back wing, thus the straps 238 criss-cross down the back of the wearer. In some embodiments, one or both straps 238 are removably attached to the brassiere 110.

Figure 6A:
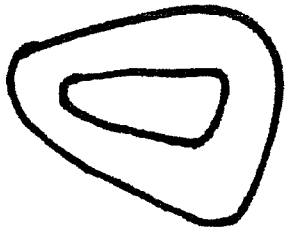
FIGS. 6A, 6B, and 6C show exemplary asymmetric rings.
Figure 6B:
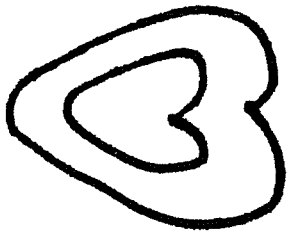

With reference to FIGS. 2, 4 and 6A-C, in some embodiments, the brassiere 110 described herein further includes a back strap joint comprising an asymmetric ring 236 connecting each strap 238 to each back wing 122. The rings 236 further limit the pull on the back band 120 due to the weight of the bust and stabilize the band 120 in its lower position on the body. The wider or longer portion of each ring 236 is directed away from the breast cup 234 and toward the end of the back wing 122 not attached to the breast cup 234. Thus, each ring 236 faces an opposite direction. In some embodiments, the asymmetric ring 236 is heart-shaped (FIG. 6B). The asymmetry of the ring 236 allows for a better angle of the strap 238 from a position closer to the center back which prevents the straps 238 from slipping off the shoulders. Thus, the rings 236 create an angle that positions the strap 238 outward without imposing a pull on the back band 120.

Figure 6C:
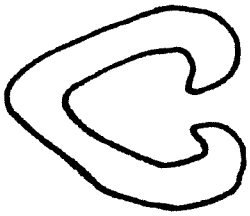

In embodiments where the straps 238 are removable from the brassiere 110, the asymmetric ring 236 has an opening on one side to allow the ring to be hooked into the fabric connected to the back wing and removed by the user (FIG. 6C). The front ring 228 connecting the strap 238 to the breast cup 234 is not asymmetric, and can be shaped as any strap ring known in the art. In some embodiments, the front rings 228 include an opening on one side to allow for removable attachment.

As shown in FIG. 2, each back wing 122 of the brassiere 110 is configured to be releasably attached to the other back wing 122 by means known in the art. In some embodiments, the back wings 122 may be attached by a hook and eye closure 256.

It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

While the invention has been described in terms of its preferred embodiments, those skilled in the art will recognize that the invention can be practiced with modification within the spirit and scope of the appended claims. Accordingly, the present invention should not be limited to the embodiments as described above, but should further include all modifications and equivalents thereof within the spirit and scope of the description provided herein.

I claim:

1. A brassiere comprising: a pair of interconnected fabric breast cups; and a pair of back wings, wherein each back wing is attached to a breast cup at a first end and configured to be releasably attached to the other back wing at a second end and wherein each back wing comprises at least two fabric panels attached end to end, wherein a portion of the panels overlap at each attachment of two panels, wherein the panels are constructed such that a top surface of each panel slopes in a downward direction starting from an end closest to the breast cup and extending to the end closest to the second end, and wherein a bottom surface of each panel slopes in a downward direction starting from the end closest to the breast cup and extending to the end closest to the second end;

further comprising a strap connecting each fabric breast cup to a section of the top surface of the panel located furthest from the fabric breast cup; and further comprising an asymmetric ring connecting each strap to each back wing, wherein the ring is asymmetrical along a longitudinal axis of the strap.

2. The brassiere of claim 1, wherein an elasticity of at least one fabric panel is different from an adjacent fabric panel.

3. The brassiere of claim 1, wherein each back wing comprises four fabric panels.

4. The brassiere of claim 3, wherein the two panels closest to the fabric breast cup have a lower elasticity than the two remaining panels.

5. The brassiere of claim 1, wherein boning is contained within a pocket created by overlapping material at each attachment of two panels.

6. The brassiere of claim 1, wherein said asymmetric ring is heart-shaped.

7. The brassiere of claim 1, wherein a wider section of each said asymmetric ring is oriented in a direction toward the second end of the back wing.

8. The brassiere of claim 7, wherein each back wing is configured to be releasably attached to the other back wing by a hook and eye closure.

9. The brassiere of claim 7, wherein each fabric breast cup comprises at least two fabric panels.

10. The brassiere of claim 7, wherein the top surface of each panel has a steeper slope than the corresponding bottom surface of the panel.

* * * * *